United States Patent [19]

Beckett

[11] Patent Number: 4,610,755

[45] Date of Patent: Sep. 9, 1986

[54] DEMETALLIZING METHOD

[76] Inventor: Donald E. Beckett, 963 Tennyson Ave., Mississauga, Ontario, Canada, L5H 2Y9

[21] Appl. No.: 723,909

[22] Filed: Apr. 16, 1985

[51] Int. Cl.[4] ..... C23F 1/02; B44C 1/22; C03C 15/00; C03C 25/06

[52] U.S. Cl. ..... 156/634; 156/635; 156/638; 156/656; 156/658; 156/665; 156/345; 252/79.5

[58] Field of Search ..... 156/345, 635, 638, 656, 156/659.1, 658, 665, 660, 634; 252/79.5

[56] References Cited

U.S. PATENT DOCUMENTS

| | | | |
|---|---|---|---|
| 3,647,508 | 3/1972 | Gorrell | 156/635 X |
| 4,348,255 | 9/1982 | Schmidt | 156/656 |
| 4,398,994 | 8/1983 | Beckett | 156/345 X |

*Primary Examiner*—William A. Powell
*Attorney, Agent, or Firm*—Sim & McBurney

[57] ABSTRACT

Demetallizing method and apparatus capable of high speed continuous production of selectively patterned metallized film, particularly polymeric film, useful in packaging products are disclosed. A water-based varnish having etchant dissolved therein is printed on the metallized surface in a desired pattern, the spent etchant solution is washed from the etched surface while the other surface is maintained out of contact with the wash water, and the etched web is dried.

13 Claims, 1 Drawing Figure

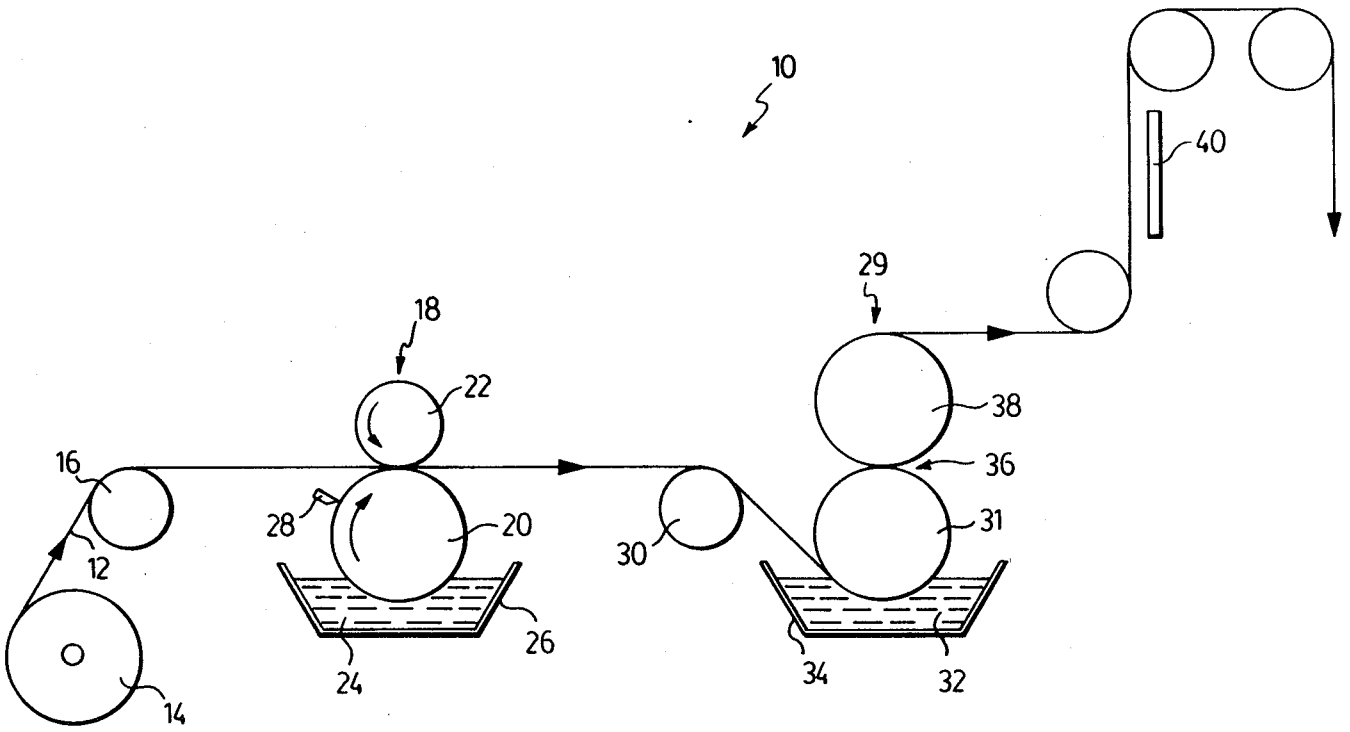
10
12
14
16
18
20
22
24
26
28
29
30
31
32
34
36
38
40

DEMETALLIZING METHOD

FIELD OF INVENTION

The present invention relates to formation of packaging material by selectively demetallizing metallized film and apparatus for effecting the same.

BACKGROUND TO THE INVENTION

In my U.S. Pat. No. 4,398,994, I have described a continuous method of forming decorative patterns of aluminized plastic film and the use of such patterned film in packaging. As is described therein, a web of aluminized polymer film is printed with a pattern of etchant-resistant material, corresponding to the pattern desired on the aluminized surface. Aqueous sodium hydroxide solution having a concentration of up to about 25 wt. % is applied, at a temperature of about 15° to about 100° C., across the whole width of the web to contact the pattern on the web. The sodium hydroxide solution is allowed to remain in contact with the web as it is conveyed for about 0.1 to about 10 seconds to permit the sodium hydroxide to dissolve aluminum only from areas of the web not having the pattern of etchant-resistant material applied thereto. The spent sodium hydroxide solution is washed from the web to leave the pattern of etchant-resistant material on the transparent polymeric film. The various steps of the operation are effected consecutively at a web speed of up to about 1000 ft/min.

The apparatus illustrated in the aforementioned patent utilizes rollers dipping into baths of liquid to effect the various steps. This manner of application of etchant and of wash water has been found to be somewhat inefficient in ensuring a consistent product at high speeds of operation and also to be uneconomical with respect to utilization of sodium hydroxide etchant.

In an attempt to overcome those difficulties, in my copending U.S. patent application Ser. No. 621,609 filed June 18, 1984, I have described a procedure in which the etchant is spray applied to the film to impinge thereon, scrapers may be used to assist in removal of etched material, warm water sprays wash the spent etchant from the film surface, the washed film is hot air dried and the air-dried film is chilled-roll cooled. By proceeding in this manner, high speed operations may be effected to produce a consistent product with economical use of etchant.

However, the latter operation requires an initial step of applying a pattern of etchant-resistant material to the aluminized surface, the application of an etchant solution over the patterned surface, and the recovery and recycle of etchant solution.

It has also previously been proposed in U.S. Pat. No. 3,647,508 to provide patterns on aluminized plastic film by a procedure which involves printing a pattern of etchant material onto a web of aluminized plastic film using a printing medium comprising a mixture of an etchant, a body-forming member and a volatile carrier. Following printing of the pattern, the volatile carrier is removed to form a spongelike trap for the etchant limiting its spread to the pattern area. Subsequently, the aluminum is washed away to provide the pattern in the etched areas.

Essential to this prior art procedure is the utilization of a volatile carrier for the etchant and some form of heating means to remove the volatile carrier from the etchant. The purpose of the volatile carrier is to enable the pattern to be set and prevent its spread.

SUMMARY OF INVENTION

In accordance with the present invention, a metallized surface of an inert substrate film is printed with a pattern of a water-based printing varnish having an etchant dissolved therein, the pattern is permitted to remain in contact with the metallized surface for a period of time sufficient to etch the pattern into the metallized surface, spent etchant is washed from the film and the washed film is dried.

In this invention, therefore, a pattern is printed onto the metallized film using a water-based printing varnish having an etchant dissolved therein. By using this medium for printing the image, rapid and effective etching is achieved and the spent etchant is readily removed by washing. This procedure contrasts markedly with that described in the prior art wherein printing of the image requires a printing medium including a volatile solvent and substantially immediate volatilization of the solvent to fix the image.

In particular, the invention is concerned with printing repetitive images on continuous webs of aluminized polymeric film. For aluminum, the etchant usually is sodium hydroxide dissolved in the water-based printing varnish. In such continuous operation, the image is conveniently printed on the aluminized film using a gravure printing roll with a water-based gravure printing varnish, preferably an acrylic-based aqueous gravure printing varnish.

By using a water-based conventional gravure printing varnish, the desired image is easily and reproducibly printed onto the aluminized surface in such a manner that the dissolved etchant rapidly etches the desired image, without any undesired spreading or the necessity to dry the etchant to prevent spreading.

Etching of the aluminized film occurs immediately upon printing and is rapidly complete, so that washing can rapidly follow the printing step, thus enabling the printing, washing and drying operations to be effected in a compact piece of equipment.

In one particularly preferred embodiment of the invention, the washing step is effected in such manner that only the etched surface of the film is contacted with wash water. This procedure significantly decreases the quantity of water which needs to be removed from the washed film to dry the same.

In the latter embodiment, it is preferred to effect the washing by passing the etched film in tight engagement with the surface of a first roll and with the etched face exposed, into a bath of wash water to remove the spent etchant, then through the nip between the first roll and a second roll and finally tightly about the surface of the second roll.

By having the tight engagement between the etched film and the first roll, the etched side of the film only is exposed to the wash water and by having the washed film then pass between the nip between the first and second roll and tightly about the second roll, a considerable amount of the wash water adhering to the film is squeezed off, thereby decreasing further the volume of water that needs to be removed by drying.

The invention has particular application to metallized polymeric films and will be described more particularly with reference thereto, but the invention may be employed with any other metallized film, for example, metallized water- and etchant-resistant paper.

BRIEF DESCRIPTION OF DRAWING

The sole FIGURE of the accompanying drawing is a schematic representation of an embodiment of an apparatus for carrying out the present invention.

DESCRIPTION OF PREFERRED EMBODIMENT

Referring to the drawing, there is schematically illustrated therein a demetallizing machine 10 for selective demetallizing of a web 12 of metallized plastic film drawn from a roll 14 thereof. The substrate polymer film may be any convenient flexible polymeric material chemically resistant to the etchant and typically is a polyester material, for example, that sold under the trade mark "Mylar". The polymer material usually is transparent but may be translucent. The metal film adhered to the plastic film, as the lower surface in the illustration, may be any convenient metal which can be removed from the surface of the substrate by chemical etching. The metal usually is aluminum, but other metals, such as copper, may be used. The thickness of the metal film may vary widely within the range of about 10 to about 1000 Å, preferably about 300 to 600 Å, and may vary in appearance from opaque to transparent. In the case of aluminum, the chemical etchant commonly is aqueous sodium hydroxide solution and the description of the preferred embodiment which follows is directed to this combination.

The web 12 of metallized plastic film is drawn over a first roll 16 to a printing station 18. The printing station 18 comprises an etched gravure printing roll 20 and a backing roll 22 which serves to maintain the web in contact with printing roll 20. The gravure printing roll 20 bears the image to be formed on the web 14.

The printing roll 20 dips into and rotates through an etchant bath 24 housed in a suitable tank 26. The etchant bath comprises a water-based gravure printing varnish having sodium hydroxide dissolved therein. A doctor blade 28 is used to wipe excess printing varnish from the surface of the gravure roll 20 and leave printing varnish only in the recessed portions of the gravure roll, corresponding to the image to be printed on the web 12.

As the web 12 engages the wetted image of the gravure roller the etchant-containing printing varnish commences etching of the aluminized surface of the web 12 in the pattern as it appears on the gravure roller. The water-based gravure printing varnish ensures that etching occurs only in the desired areas and does not run into the adjacent areas. In this way, the etched image is sharp and has the desired appearance.

The water-based gravure printing varnish is a conventional unpigmented water-based printing ink useful in gravure printing. These materials generally comprise water and a water-soluble binder, which may be acrylic-based. The sodium hydroxide is dissolved in the aqueous base to provide the etchant medium. The quantity of sodium hydroxide employed may vary widely, although is generally relatively low, below about 15 wt. % of the varnish. Preferably, the concentration of sodium hydroxide is in the range of about 5 to about 10 wt. %.

Although the process will operate satisfactorily at ambient temperatures, it is preferable to use the aqueous etch medium at an elevated temperature, to increase the speed of etching and to provide thereby for an increased throughput of film and speed of operation. Elevated temperatures of about 50° to about 95° C. preferably are employed and may be achieved by heating the bath 24.

By the utilization of the water-based printing varnish with the gravure roll, etching of the metal on the web occurs in the same pattern as appears on the gravure roll to provide a sharply-outlined image. A visible pattern of metallized and demetallized area results.

The web 12 passes from the printing station 18 to a washing station 29 wherein the etched image is washed free from spent etchant. The temperature and concentration of etchant solution are coordinated with web speed to ensure that etching of the metal in the printed pattern is substantially complete by the time the web 12 reaches the washing station 26.

In the washing station 29, the web 14 first engages an idle roll 30 before passing into engagement with the lower one 31 of a pair of rolls to be guided through a bath 32 of wash water in a suitable tank 34. The web 14 is tightly wrapped around roll 31, passes through the nip 36 between the lower roll 31 and upper roll 38 and then passes tightly around the upper roll 38. The size of the roll 31 and the depth to which it is submerged in the bath 32 are chosen, in combination with the tight wrapping of web 12 about roll 31, to ensure that only the surface of the web 12 which is contacted with etchant comes into contact with the wash water. In this way, the amount of water which needs to be removed from the film during drying is significantly decreased.

In continuous operation, the wash water in the water bath 32 is constantly changed to ensure as high a cleanliness of washed web as possible.

As the web 12 passes through the nip 36 between the rolls 31 and 38 and the washed surface of the web comes into engagement with roll 38, water is squeezed from the washed surface, leaving little water adhered to the washed surface. The web next is guided past a drier 40 which removes the residual water, such as by hot air or infra-red heat.

The dried web may be reeled up or may be subjected to a single or multiple one-color printings, as described.

Utilizing the procedure outlined above, etching of the aluminum film by the image printed from the gravure roller occurs rapidly and high speed operation, usually up to about 1000 ft/min can be achieved in a compact demetallizing machine, preferably about 100 to about 700 ft/min.

The demetallizing machine 10 illustrated in the drawings is capable of operating at speeds which are compatible with those of flexographic and gravure printing presses, so that the demetallizing operation may be run on-line with subsequent color printing of the film on modern film-printing machinery.

The roll of clean dried patterned film which results from the demetallizing operation may be used as is or color printed as a packaging material for a variety of products. The patterned film often is laminated with another, often polymeric, film to impart desirable properties thereto, for example, heat sealing properties and improved strength properties, prior to use of the laminate as a packaging material.

When lamination with the patterned web is to be effected, such operation may be carried out separately on a roll of the patterned web or may be effected on-line with the demetallizing operation following the drying of the patterned web, optionally in combination with multiple color printing.

The demetallizing machine 10 illustrated in the drawings may be used efficiently to remove any desired proportion of the metal present on the web surface, depending on the pattern desired, by use of the appropriately-patterned gravure plate. The web speed and other operating parameters, for example, sodium hydroxide concentration and temperature may be adjusted to take into account varying thicknesses of metal film.

SUMMARY OF DISCLOSURE

In summary of this disclosure, the present invention provides an improved method and apparatus for selectively etching a metallized film to achieve continuous reliable high speed operation. Modifications are possible within the scope of this invention.

What I claim is:

1. A method of forming a pattern on a metallized film, which comprises:

printing onto the metallized surface of the film a pattern of a water-based varnish having an etchant dissolved therein, permitting said pattern to remain in contact with the metallized surface for a period of time sufficient to etch said pattern into the metallized surface, washing spent etchant from said film, and drying the resulting washed film.

2. The method of claim 1 wherein said water-based varnish is a water-based gravure printing varnish.

3. The method of claim 2 wherein said varnish is an acrylic-based aqueous varnish.

4. The method of claim 1 wherein said metal is aluminum, said etchant comprises sodium hydroxide dissolved in said water-based varnish, said metallized film is provided as a continuous web of polymeric material, and said steps of printing, washing and drying are effected sequentially in a continuous processing of the web.

5. The method of claim 4 wherein said printing is effected using a gravure roller, said aqueous varnish is a water-based gravure printing varnish and said sodium hydroxide is present in said varnish in a concentration of less than about 15 wt. %.

6. The method of claim 5 wherein said printing is effected at a temperature of about 50° to about 95° C.

7. The method of claim 1 wherein said washing step is effected in such manner that only the patterned surface of the film is contacted with wash water.

8. The method of claim 4 wherein said washing step is effected in such manner that only the patterned surface of the film is contacted with wash water.

9. The method of claim 5 wherein said washing step is effected in such manner that only the patterned surface of the film is contacted with wash water.

10. The method of claim 9 wherein said washing step is effected by guiding the patterned web into engagement with the wash water with the etched surface in contact with the wash water while the other surface is maintained out of contact with the wash water, and squeezing the washed film to remove water from the washed surface thereof.

11. The method of claim 4 including laminating the patterned polymer web with at least additional web of polymeric material.

12. The method of claim 4 including printing said film with at least one color.

13. The method of claim 12, in which multiple color gravure printing of the selectively-demetallized patterned film is effected in register to provide a colored image.

* * * * *